US007475639B2

(12) United States Patent
Chen

(10) Patent No.: US 7,475,639 B2
(45) Date of Patent: Jan. 13, 2009

(54) FOLDING METHODS FOR CARDBOARD PALLETS

(76) Inventor: Frank Lawrence Chen, 301 Parnassis Ave., Apt 207, San Francisco, CA (US) 94117

( * ) Notice: Subject to any disclaimer, the term of this patent is extended or adjusted under 35 U.S.C. 154(b) by 348 days.

(21) Appl. No.: 11/308,497

(22) Filed: Mar. 30, 2006

(65) Prior Publication Data

US 2007/0227410 A1 Oct. 4, 2007

(51) Int. Cl.
*B65D 19/00* (2006.01)

(52) U.S. Cl. ..... 108/51.3

(58) Field of Classification Search ..... 108/51.11, 108/51.3, 56.1, 56.3, 57.19, 57.22, 57.29, 108/52.1; 206/386, 596, 598, 599, 600, 6.1; 229/120.26, 120.29; 248/346.01, 346.02
See application file for complete search history.

(56) References Cited

U.S. PATENT DOCUMENTS 2,388,730 A * 11/1945 Fallert ..... 108/51.3
2,920,807 A * 1/1960 Bruce ..... 206/386
3,416,653 A * 12/1968 Farquhar ..... 206/139
3,602,158 A * 8/1971 Skaggs ..... 108/51.3
5,184,558 A * 2/1993 Wozniacki ..... 108/51.3
5,218,913 A * 6/1993 Winebarger et al. ..... 108/51.3
5,222,444 A * 6/1993 Youell et al. ..... 108/51.3
5,372,570 A * 12/1994 Schmidtke et al. ..... 493/399
5,406,892 A * 4/1995 Kilpatrick et al. ..... 108/51.3
5,469,795 A * 11/1995 Moorman ..... 108/51.3
5,941,177 A * 8/1999 Anderson ..... 108/51.3
7,426,890 B2 * 9/2008 Olvey ..... 108/51.3

* cited by examiner

*Primary Examiner*—Janet M Wilkens

(57) ABSTRACT

A unit of the cardboard pallet is formed by a single piece of cardboard. First, the two side portions are folded up towards the centerline. Then, the cardboard piece is folded up along the centerline. Next, the two end portions are folded outwards to a right angle. Now, a unit with a "T" shaped cross section and an enhanced strength is formed.

2 Claims, 10 Drawing Sheets

FOLDING METHODS FOR CARDBOARD PALLETS

BACKGROUND OF THE INVENTION

1. Field of the Invention

The invention generally relates to several folding methods for cardboard pallets. More particularly, the invention relates to several folding methods by which structurally simple, easy-to-assemble cardboard pallets with an enhanced strength may be formed with a low production cost.

2. Description of the Prior Art

The bottom supporting structure of a conventional goods-carrying box is typically made of foam because foam is light, sturdy and inexpensive. Because foam is not bio-degradable and sends out poisonous fume when burned, it is quite environmentally unfriendly. Hence, if the use of foam is not banned, it may cause serious impacts on the environment.

Hence, many countries have banned the use of foam. Other materials have been used to replace foam as the bottom supporting structure of a box. As of now, wood and metal have been used for this purpose. Though the bottom supporting structure made of wood or metal has a great strength and hence may be used to carry heavy goods, such structure is relatively heavy and hence requires a higher transport cost; in addition, it is more difficult to recycle such structure.

Hence, cardboard pallet has been used for this purpose. The only disadvantage of the cardboard pallet of the prior art is its lack of strength because it is made of a single layer of cardboard; hence, such pallet can not be used to carry heavy goods. An improved cardboard pallet is made of several layers of cardboard; however, such pallet is more difficult to produce because several layers of cardboard need to be glued together and one or more slots need to be provided. Whence, the production cost of such improved cardboard pallet is quite high.

To eliminate these disadvantages, the inventor put a lot of effort in the subject and has successfully come up with the folding methods of the present invention by which structurally simple cardboard pallets with great strength may be formed.

SUMMARY OF THE INVENTION

An object of the present invention is to provide several folding methods for cardboard pallets so that the strength of cardboard pallets may be enhanced and the pallets of the present invention may be used to carry heavier goods.

Another object of the present invention is to provide several folding methods for cardboard pallets so that a unit may be formed by a single piece of cardboard without using any adhesive and the strength of the pallets of the present invention may be greatly enhanced without any increase in the production cost.

A unit of the present invention is formed by a single piece of cardboard. First, the two side portions are folded up towards the centerline. Then, the cardboard piece is folded up along the centerline. Next, the two end portions are extended outwards and horizontally. Now, a unit with a "T" shape cross section and an enhanced strength is formed.

BRIEF DESCRIPTION OF THE DRAWINGS

The drawings disclose a preferred embodiment of the present invention which serves to exemplify the various advantages and objects hereof, and are as follows.

DETAILED DESCRIPTION OF THE PREFERRED EMBODIMENT

Figure 1:
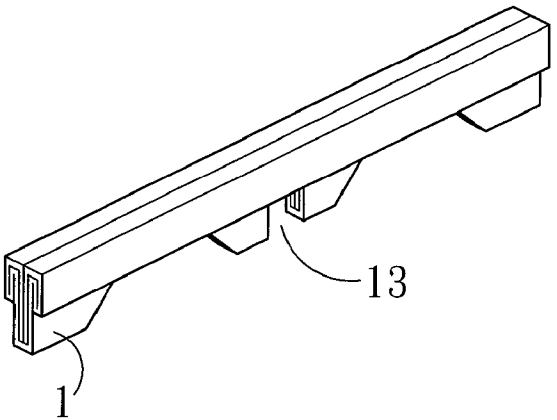
FIG. 1 is a perspective view of a unit of cardboard pallet according to the present invention.
Figures 3, 4, 5:
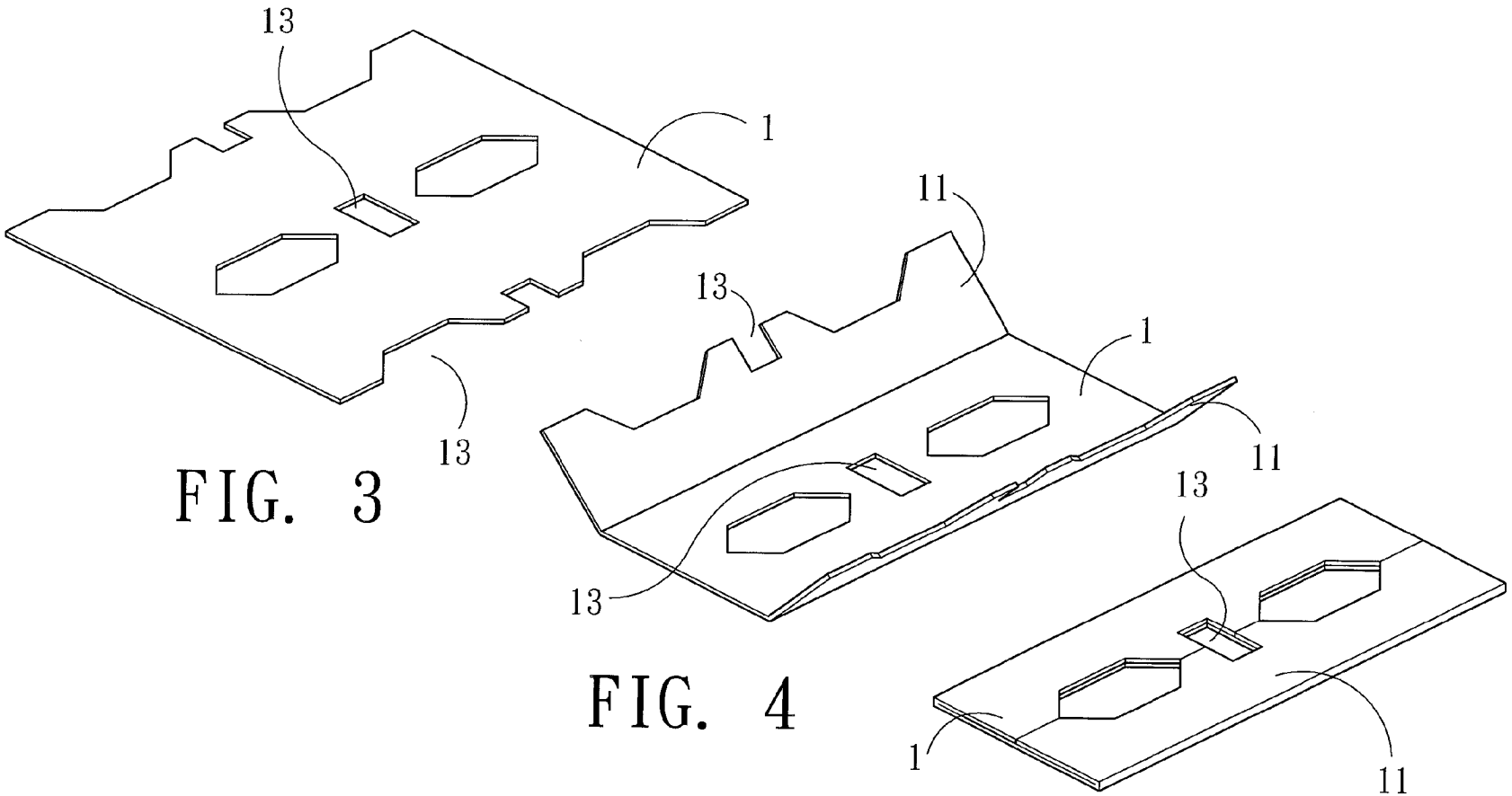
FIG. 3 is a perspective view showing how a pre-cut piece of cardboard is folded into a unit of the present invention (1)
FIG. 4 is a perspective view showing how a pre-cut piece of cardboard is folded into a unit of the present invention (2)
FIG. 5 is a perspective view showing how a pre-cut piece of cardboard is folded into a unit of the present invention (3)
Figure 6:
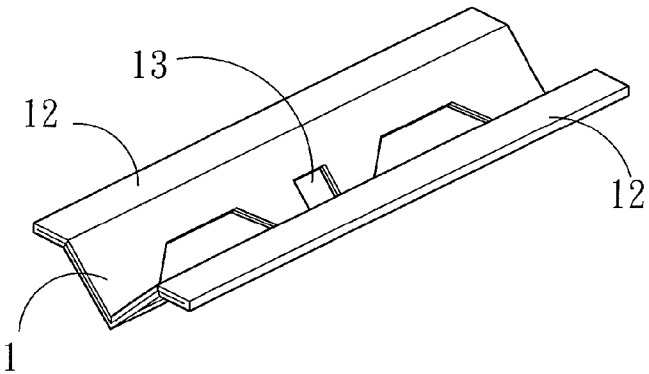
FIG. 6 is a perspective view showing how a pre-cut piece of cardboard is folded into a unit of the present invention (4)
Figure 7:
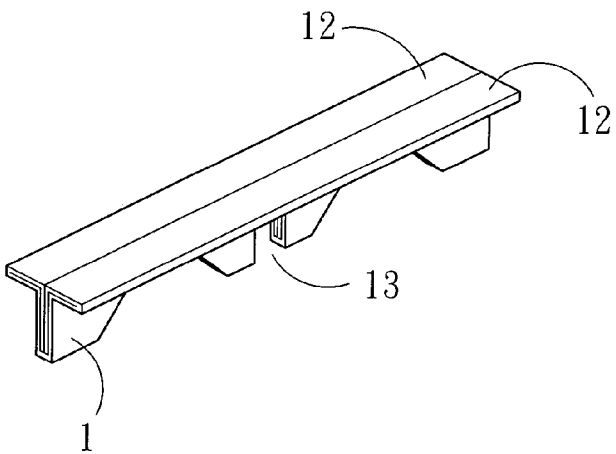
FIG. 7 is a perspective view showing how a pre-cut piece of cardboard is folded into a unit of the present invention (5)

Please refer to FIG. 1. A unit 1 of the cardboard pallet of the present invention is formed by cardboard. The unit 1 has a "T" shaped cross section and a thicker top portion. A slot 13 is provided so that the unit 1 may be used with other units to enhance its strength.

Figure 2:
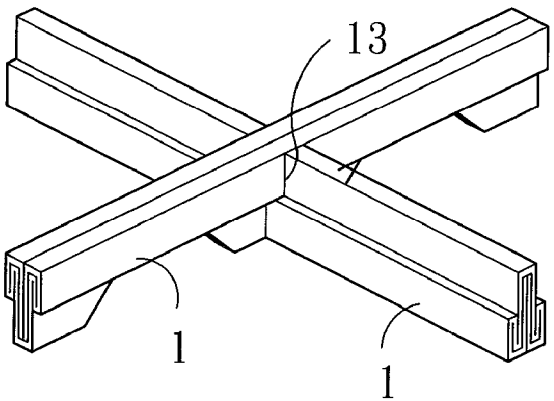
FIG. 2 is a perspective view showing how two units of the present invention are put together to form a pallet.
Figure 12:
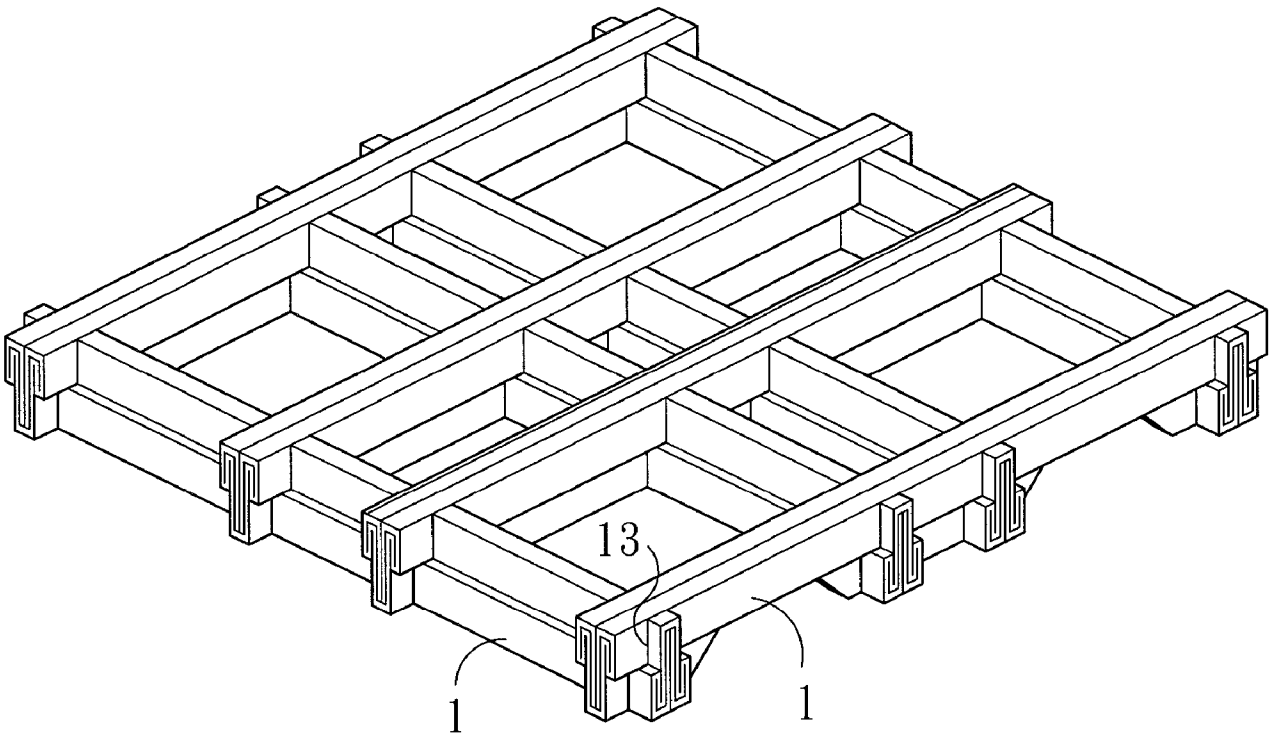
FIG. 12 is a perspective view showing an assembled pallet formed by several units.

Please refer to FIG. 2. Several units 1 may be put together to form a complete pallet 1 as illustrated in FIG. 12. Because each unit 1 is comprised of several layers of cardboard, its strength is enhanced. In the cardboard cutting process, a portion of the cardboard is cut up and discarded so that the slot 13 may be formed after the unit 1 is folded up.

FIGS. 3 to 7 show how a unit is formed by folding. A unit 1 is formed by a single piece of cardboard. First, the two side portions 11 are folded up towards the centerline. Then, the cardboard piece is folded up along the centerline. Next, the two end portions 12 are extended outwards and horizontally. Now, a unit 1 with a "T" shaped cross section is formed; its vertical part is comprised of four layers of cardboard and its top part is comprised of two layers of cardboard so as to enhance its strength.

The pallet forming method requires one cutting process and three times of folding; hence, this method is simple and of low in cost.

Figure 8:
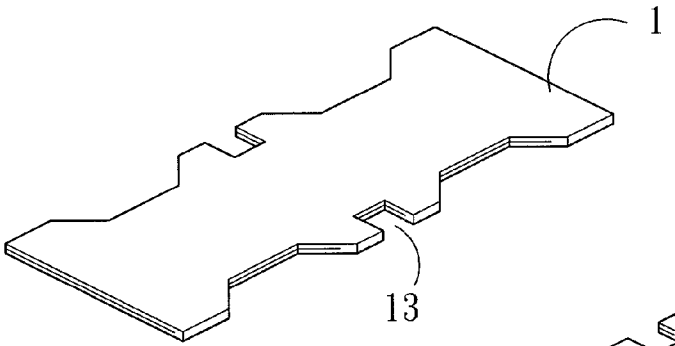
FIG. 8 is a perspective view showing another folding method (1)
Figure 9:
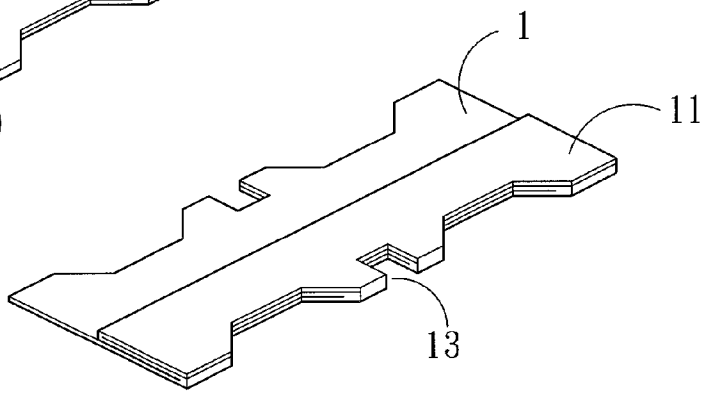
FIG. 9 is a perspective view showing another folding method (2)
Figure 10:
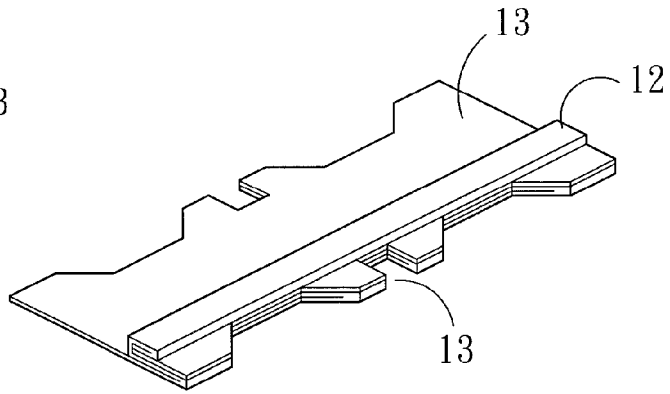
FIG. 10 is a perspective view showing another folding method (3)

FIGS. 8 to 10 show another folding method. First, the two side portions 11 are folded up along the centerline. Then the two side portions 11 are folded back towards the center line. Then, the two end portions 12 are folded outwards. Now, a unit 1 with a "T" shaped cross section is formed. This pallet forming method provides an additional forming method to the first forming method.

Figure 11:
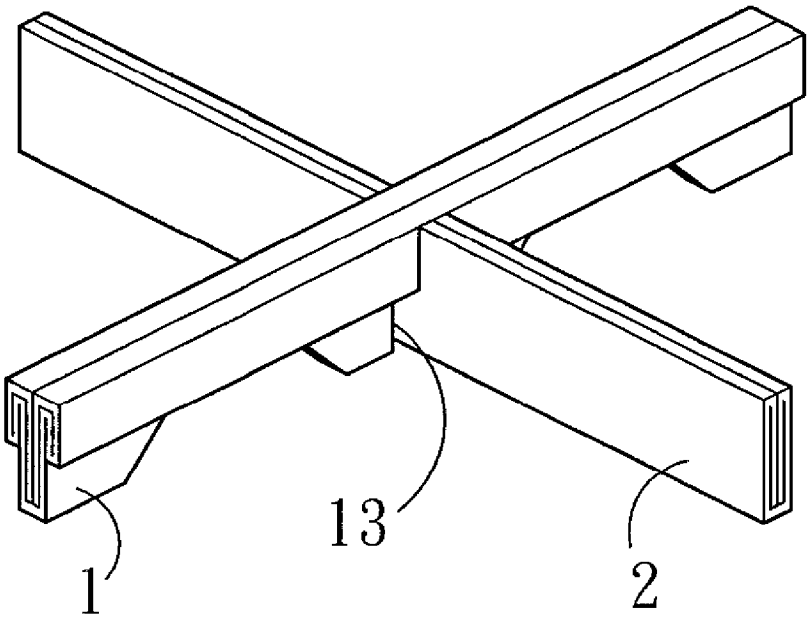
FIG. 11 is a perspective view showing that a unit is used with another unit with a simpler construction.
Figure 13:
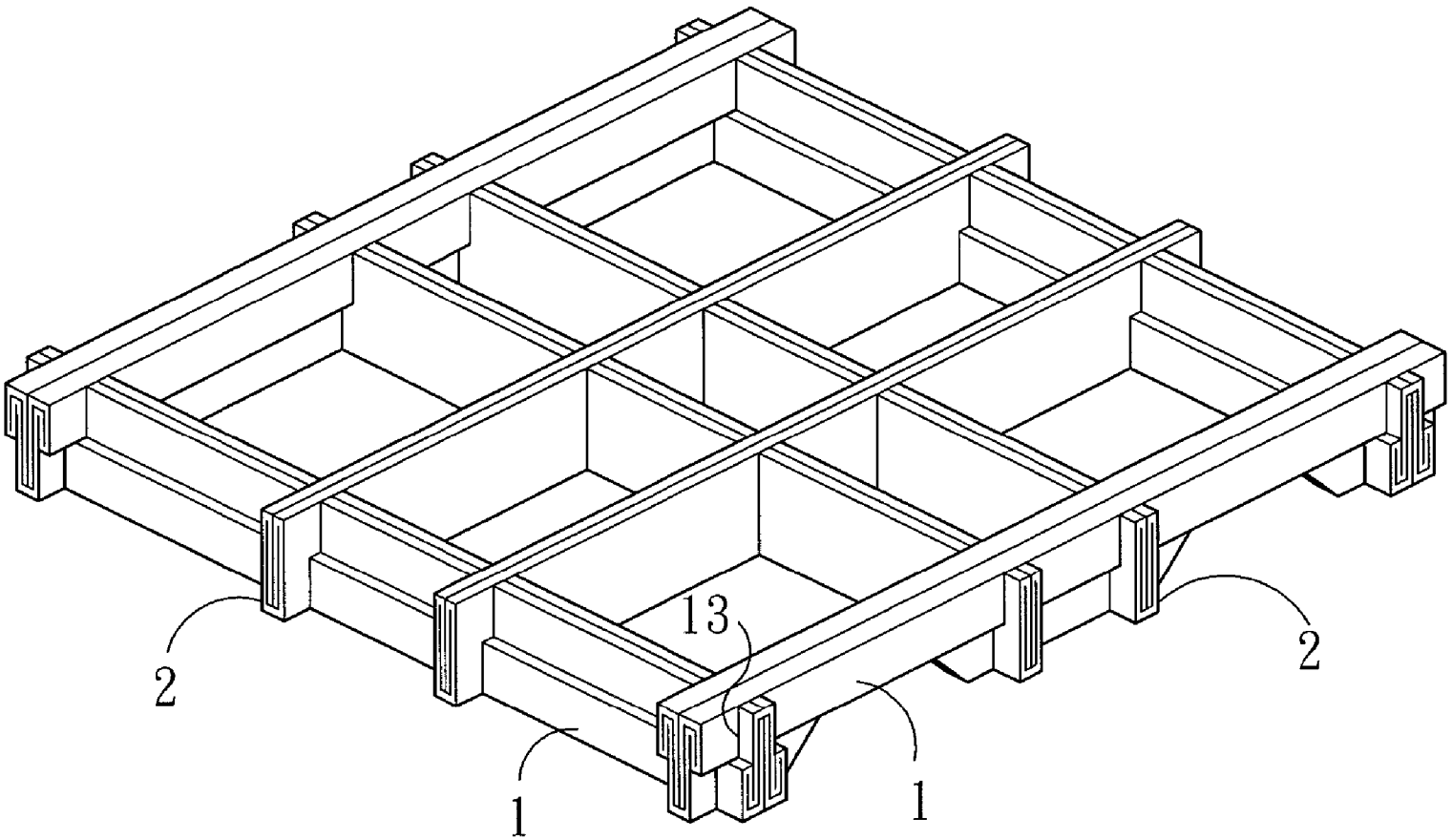
FIG. 13 is a perspective view showing another assembled pallet formed by several units.
Figure 14:
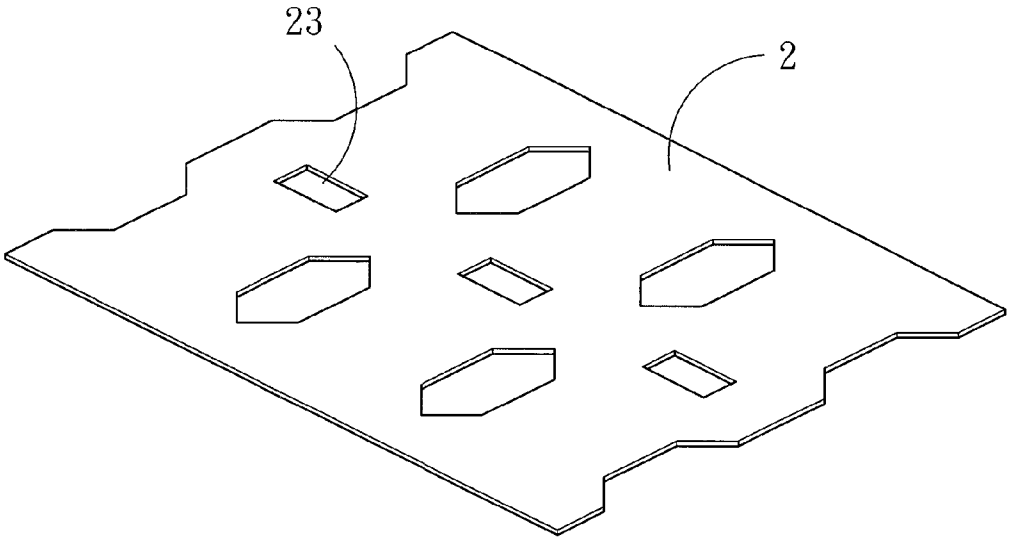
FIG. 14 is a perspective view showing how another type of cardboard piece is folded into a unit (1)
Figure 15:
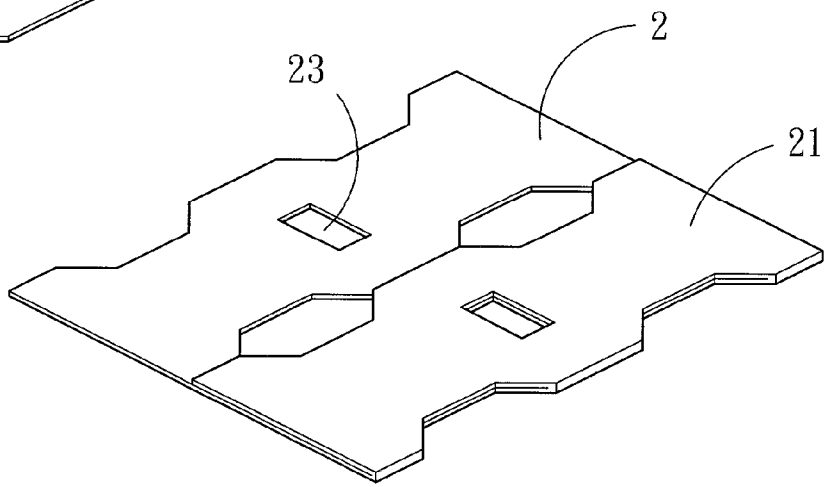
FIG. 15 is a perspective view showing how another type of cardboard piece is folded into a unit (2)

FIG. 11 illustrates a folded unit 1 may be used with another unit 2 with a simpler construction to form a simple pallet. In this example, the unit 2 is also comprised of cardboard and formed by a simple folding method. As illustrated in FIG. 13, several units 1 and several units 2 may be put together to form a pallet with a great strength.

Figure 17:
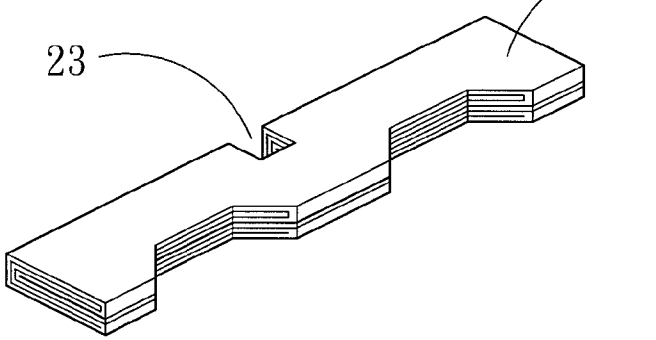
FIG. 17 is a perspective view showing how another type of cardboard piece is folded into a unit (4)
Figure 16:
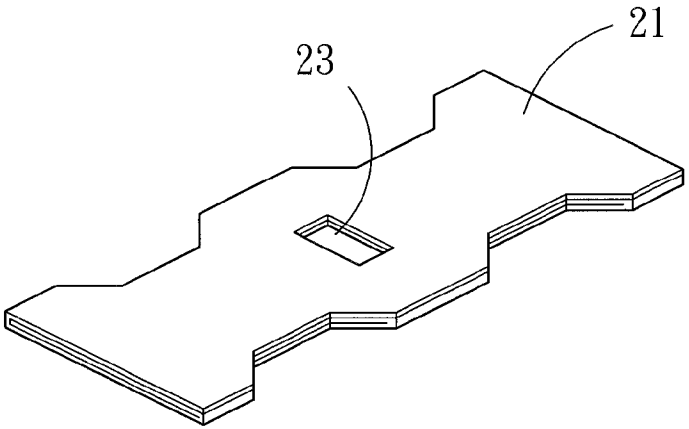
FIG. 16 is a perspective view showing how another type of cardboard piece is folded into a unit (3)
Figure 18:
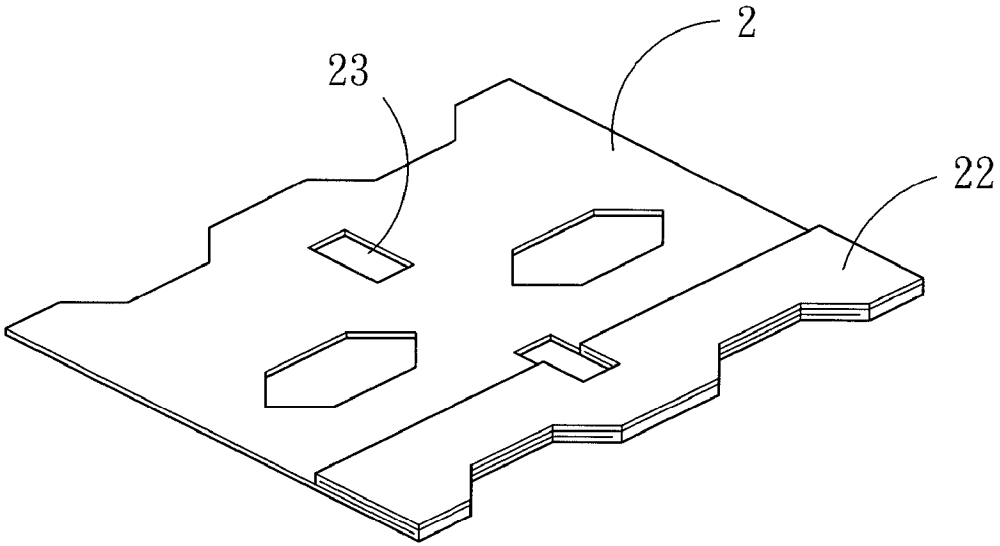
FIG. 18 is a perspective view showing how another type of cardboard piece is folded into a unit (5)
Figure 19:
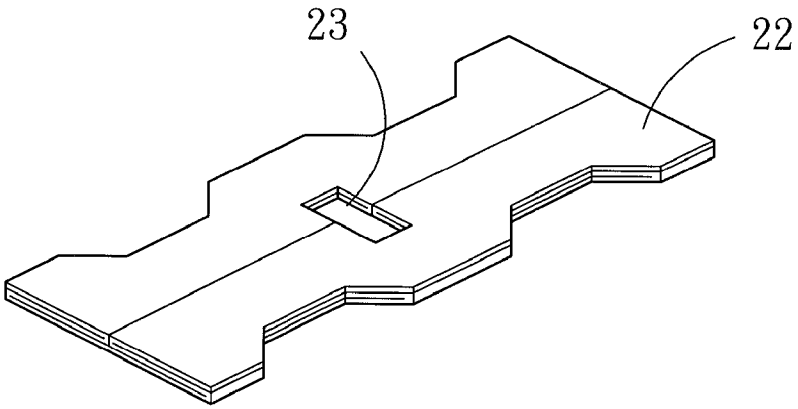
FIG. 19 is a perspective view showing how another type of cardboard piece is folded into a unit (6).

FIGS. 15 to 19 illustrate how the unit 2 is formed. A cut-up piece of cardboard comprises three equally partitioned portions. First, the right portion 21 is folded inwards to press against the middle portion as showed in FIG. 15. Then, a left portion 21 is also folded inwards as showed in FIG. 16. Next, the cardboard is folded up along its centerline as showed in FIG. 17. As previously described, in the cardboard cutting process, a portion of the cardboard is cut up and discarded so that a slot 23 may be formed after the unit 2 is folded up. Alternatively, first, the right portion 21 is folded inwards to press against the middle portion as showed in FIG. 15. Then, the end portion 22 of the right portion 21 is folded outwards as shown in FIG. 18. Next, the left portion 21 is folded inwards to press against the middle portion and the end portion 22 of the right portion 21 is folded outwards as shown in FIG. 19. Now, the unit 2 is formed (as illustrated in FIG. 17).

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A folding method for cardboard pallets, comprising the following steps:

(1) cutting up a single piece of cardboard to a shape having two symmetrical side portions along a centerline;

(2) folding the two side portions towards the centerline to form two symmetrical dual-layered side portions;

(3) folding up the cardboard piece along the centerline; and (4) folding two entirely dual-layered end portions of the two symmetrical dual-layered side portions outwards to a right angle to form a unit with a "T" shaped cross section and with its vertical part comprised of four layers of cardboard and its two top parts respectively folded onto two sides of the vertical part comprised of two layers of cardboard.

2. The folding method as in claim 1, wherein a portion of the cardboard is cut up and removed in the cutting process so that a slot is formed when the unit is folded up.

* * * * *